US007474267B2

(12) United States Patent
Chen et al.

(10) Patent No.: US 7,474,267 B2
(45) Date of Patent: Jan. 6, 2009

(54) BROADBAND ANTENNA AND ELECTRONIC DEVICE HAVING THE BROADBAND ANTENNA

(75) Inventors: Chih Lung Chen, Taipei Hsien (TW); Chih Kai Liu, Taipei Hsien (TW)

(73) Assignee: Wistron Neweb Corporation, Taipei Hsien (TW)

( * ) Notice: Subject to any disclaimer, the term of this patent is extended or adjusted under 35 U.S.C. 154(b) by 254 days.

(21) Appl. No.: 11/257,010

(22) Filed: Oct. 25, 2005

(65) Prior Publication Data

US 2007/0018896 A1 Jan. 25, 2007

(30) Foreign Application Priority Data

Jul. 21, 2005 (TW) ..... 94212355 U

(51) Int. Cl.
*H01Q 1/24* (2006.01)

(52) U.S. Cl. ..... 343/702; 343/700 MS

(58) Field of Classification Search ..... 343/700 MS, 343/702, 846, 848

See application file for complete search history.

(56) References Cited

U.S. PATENT DOCUMENTS

| | | | | |
|---|---|---|---|---|
| 6,750,821 | B2 * | 6/2004 | Fang et al. | 343/700 MS |
| 6,861,986 | B2 | 3/2005 | Fang et al. | |
| 6,864,841 | B2 * | 3/2005 | Dai et al. | 343/700 MS |
| 7,193,564 | B2 * | 3/2007 | Takagi et al. | 343/700 MS |
| 7,202,825 | B2 * | 4/2007 | Leizerovich et al. | 343/702 |
| 7,265,720 | B1 * | 9/2007 | Ponce De Leon et al. | 343/700 MS |
| 2004/0056804 | A1 * | 3/2004 | Kadambi et al. | 343/700 MS |

* cited by examiner

*Primary Examiner*—HoangAnh T Le
(74) *Attorney, Agent, or Firm*—Bacon & Thomas, PLLC

(57) ABSTRACT

The present invention provides a broadband antenna that is used in wireless communication systems. The broadband antenna includes a closed looped radiating element having a body section and a hollow section formed by closed compassing by the body section; a grounding element; and a connecting element having a first end electrically connected to the closed looped radiating element and a second end electrically connected to the grounding element. The antenna of the present invention can provide a wider frequency bandwidth and better antenna efficiency.

9 Claims, 7 Drawing Sheets

BROADBAND ANTENNA AND ELECTRONIC DEVICE HAVING THE BROADBAND ANTENNA

BACKGROUND OF THE INVENTION

1. Field of the Invention

The present invention relates to an antenna, and more particularly, to a dual frequency broadband antenna.

2. Description of the Related Art

With the developments in wireless communications technology, many electronic devices, such as notebooks and mobile phones, now incorporate wireless communications abilities. In order to receive and transmit signals, these electronic devices need to have an antenna for detecting electromagnetic radiation.

Since both mobile phones and notebooks have became important in the daily lives of many people, if it were possible to combine these two devices, such a combined-function device would offer significantly more convenience for users. However, the prior art antennas for typical mobile phones usually have a narrow frequency bandwidth of about 70 MHz at a low frequency range (900 MHz), and a narrow frequency bandwidth of about 120 MHz at a high frequency range (1800 MHz) when a VSWR (Voltage Standing Wave Ratio) is less than 4. Additionally, the antenna efficiency of the typical mobile phones is typically low as around 20~30%; therefore, if the prior art mobile phone antenna is installed in a notebook, the antenna will not provide very satisfactory results.

A prior art technology has disclosed a dual frequency antenna that can provide a wider frequency bandwidth than earlier mobile phone antennas. Please refer to FIG. 1. FIG. 1 shows a prior art antenna 90, as disclosed in U.S. Pat. No. 6,861,986. As shown in FIG. 1, the antenna 90 has a radiating element 91, a connecting element 92 and a grounding element 93. The connecting element 92 has a first end 921 and a second end 922, wherein the first end 921 is coupled to the radiating element 91, and the second end 922 is coupled to the grounding element 93. The antenna 90 can be used for WWAN, WLAN 802.11a or 802.11b, Bluetooth or GSM communications systems. Compared to the typical mobile phone antenna, the antenna 90 has a wider frequency bandwidth, usually having a frequency bandwidth of about 120 MHz at the low frequency range (900 MHz) and a frequency bandwidth of about 480 MHz at the high frequency range (1800 MHz) when the VSWR is less than 3.

Although the prior art technology already provides a broadband antenna, the frequency bandwidth still can be improved. Furthermore, if a new antenna can provide a wider frequency bandwidth with a smaller size, such a new antenna would have better platform compatibility characteristics, and would have lower manufacturing costs.

Therefore, it is desirable to provide a dual frequencies broadband antenna to mitigate and/or obviate the aforementioned problems.

SUMMARY OF THE INVENTION

An objective of the present invention is to provide a broadband antenna with wider frequency bandwidth.

The broadband antenna of the present invention has a closed looped structure and comprises: a closed looped radiating element, a grounding element and a connecting element. The closed looped radiating element has a body section and a hollow section formed by closed compassing by the body section. The connecting element has a first end electrically connected to the closed looped radiating element and a second end electrically connected to the grounding element.

In one embodiment of the present invention, the first end of the connecting element is substantially perpendicular to a surface where the grounding element is located, or is substantially parallel to the surface where the grounding element is located.

In one embodiment of the present invention, the closed looped radiating element can have one hollow section or a plurality of hollow sections; and the closed looped radiating element can be composed by a flat board or a pillar.

In one embodiment of the present invention, the body section and the hollow section of the closed looped radiating element can be triangular, rectangular or any other shapes.

Furthermore, the present invention also provides a broadband antenna having a radiating element, a grounding element and a closed looped connecting element. The connecting element has a first end electrically connected to the radiating element and a second end electrically connected to the grounding element, and the first end is a closed looped structure having a body section and a hollow section formed by closed compassing by the body section.

In one embodiment of the present invention, the closed looped connecting element can have one hollow section or a plurality of hollow sections, and the body section and the hollow section can be triangular, rectangular or any other shapes.

Moreover, the present invention also provides an electronic device having the above-mentioned broadband antenna such as a notebook computer, a mobile phone or a PDA. Furthermore, in one embodiment of the present invention, the broadband antenna can be placed at different positions according to the layout design of the electronic device.

When the VSWR is less than 3, the broadband antenna according to the present invention has a frequency bandwidth of about 200 MHz at the low frequency range (900 MHz) and a frequency bandwidth at the high frequency range (1800 MHz) of about 500 MHz, and its antenna efficiency is better than the prior art technology.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
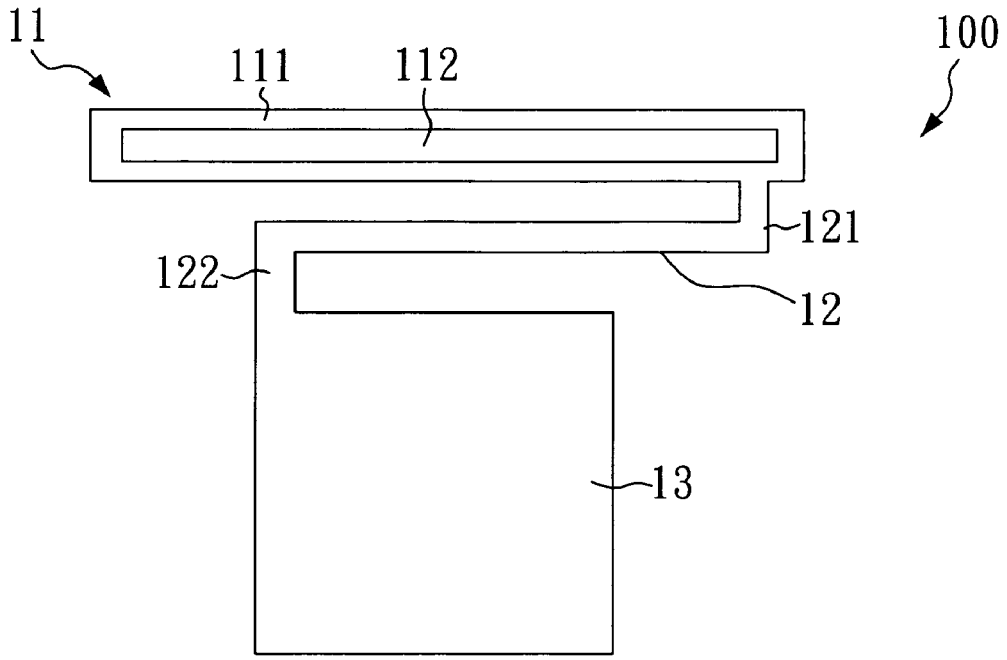
FIG. 2 is a schematic drawing of a broadband antenna according to a first embodiment of the present invention.

Please refer to FIG. 2. FIG. 2 is a schematic drawing of a broadband antenna according to a first embodiment of the present invention. As shown in the drawing, in the first embodiment, the broadband antenna 100 comprises a closed looped radiating element 11, a connecting element 12, and a grounding element 13.

The connecting element 12 has a first end 121 and a second end 122. The first end 121 is electrically connected to the closed looped radiating element 11, and the second end 122 is electrically connected to the grounding element 13. The broadband antenna 100 of the present invention is electrically connected to a radio receiving/transmitting device (not shown) so that the closed looped radiating element 11 can receive or transmit electromagnetic wave. Since the connecting element 12, the grounding element 13 and the radio receiving/transmitting device are very well known technology, they require no further description.

Figure 1:
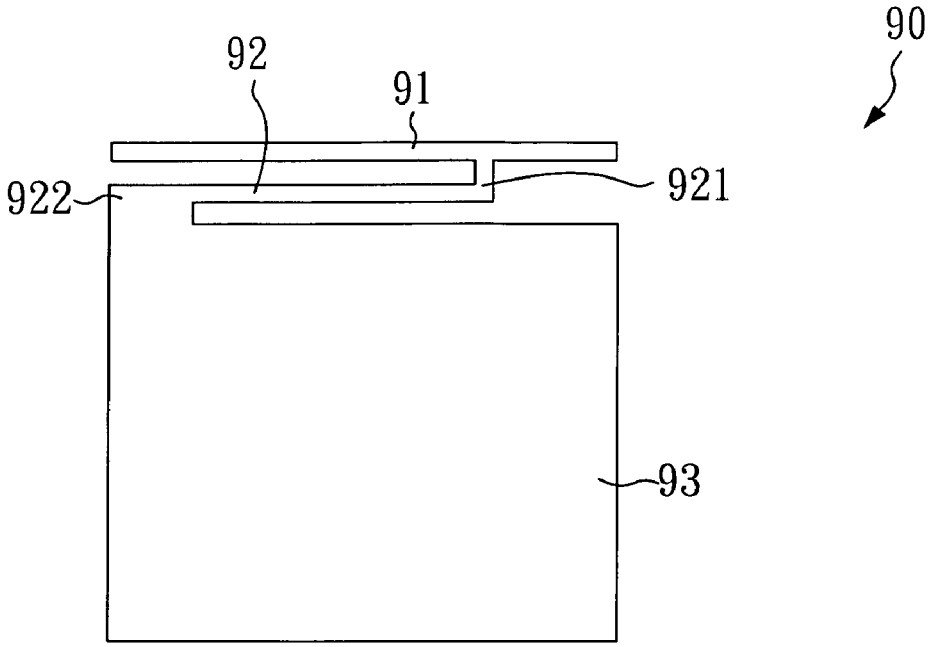
FIG. 1 (Prior Art)
FIG. 1 is a schematic drawing of a prior art broadband antenna.

As shown in FIG. 2, the main difference between the broadband antenna 100 and the prior art antenna 90 is that the radiating element 91 (as shown in FIG. 1) of the antenna 90 is replaced by the closed looped radiating element 11.

As shown in FIG. 2, the closed looped radiating element 11 is formed by a conductive plate, which has a body section 111 and a hollow section 112 formed by closed compassing by the body section 111. In the drawing, the body section 111 and the hollow section 112 are substantially rectangular, but this should not be construed as a limitation. The body section 111 and the hollow section 112 can also be triangular, pentagonal or other shapes.

Figure 3:
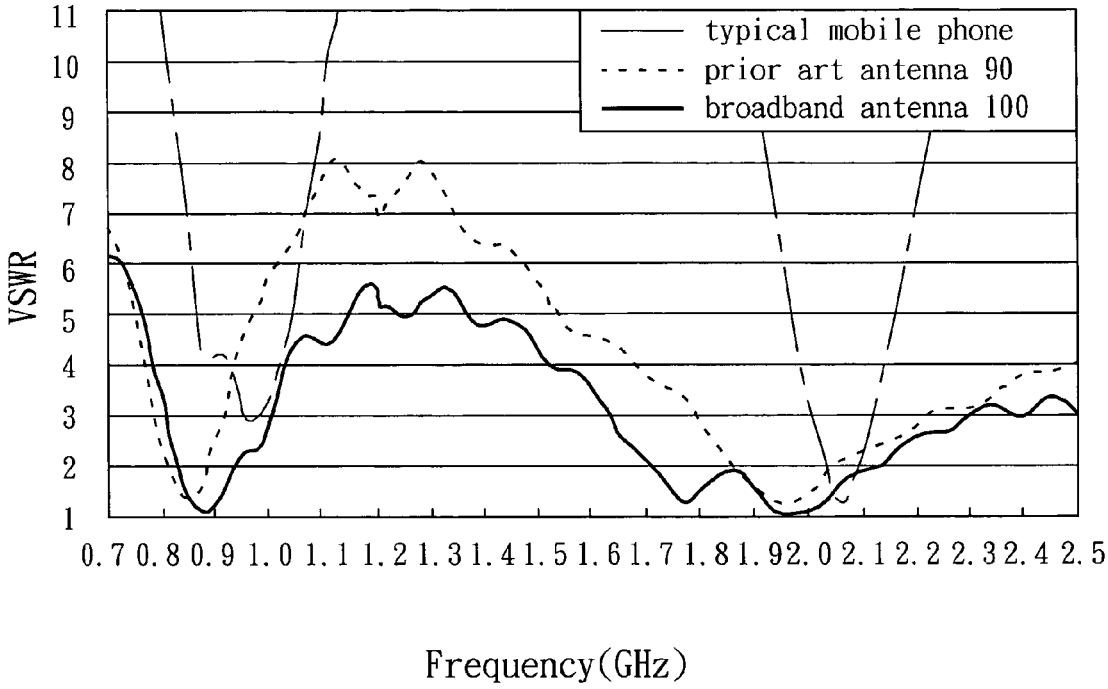
FIG. 3 shows different frequency bandwidths of different antennas.

Compared to the prior art, the broadband antenna 100 has not only a dual band response, but also has a wider frequency bandwidth. Please refer to FIG. 3. FIG. 3 shows the frequency response of a typical mobile phone antenna, the prior art antenna 90, and the broadband antenna 100 of the present invention with respect to the VSWR.

In FIG. 3, when the VSWR is less than 3, the typical mobile phone has the most narrow frequency bandwidth; its frequency bandwidth at the low frequency range (900 MHz) is about 10 MHz, and the frequency bandwidth at the high frequency range (1800 MHz) is about 100 MHz. The prior art antenna 90 has a wider frequency bandwidth, with a frequency bandwidth at the low frequency range (900 MHz) of about 120 MHz, and a frequency bandwidth at the high frequency range (1800 MHz) of about 480 MHz. The broadband antenna 100 of the present invention has the widest frequency bandwidth, with a frequency bandwidth at the low frequency range (900 MHz) of about 200 MHz, and a frequency bandwidth at the high frequency range (1800 MHz) of about 500 MHz. It is clear that the broadband antenna 100 of the present invention has a wider frequency bandwidth, and a higher efficiency, than the typical mobile phone and the prior art antenna 90.

Figure 4:
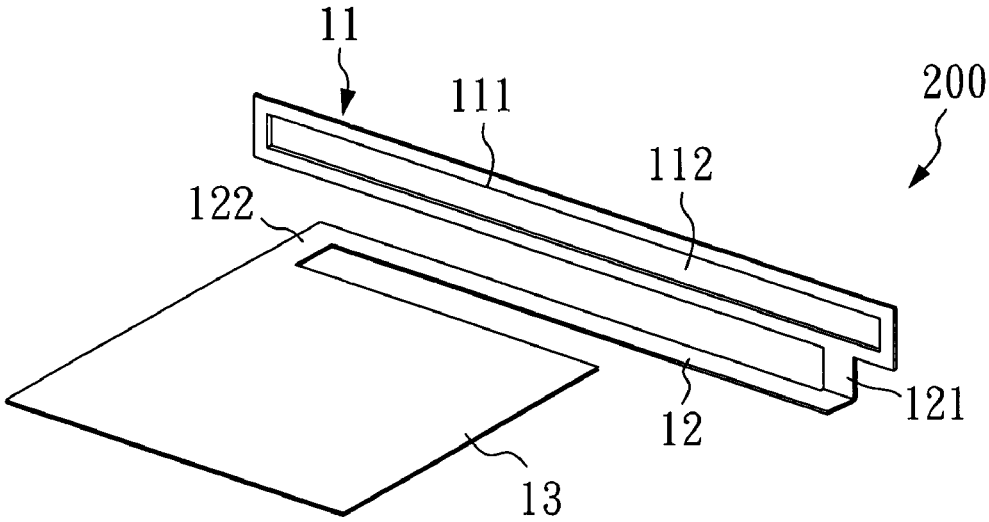
FIG. 4 is a schematic drawing of a broadband antenna according to a second embodiment of the present invention.

Please refer to FIG. 4. FIG. 4 is a schematic drawing of a broadband antenna according to a second embodiment of the present invention. As shown in FIG. 4, the main difference between the broadband antenna 200 of the second embodiment of the present invention and the broadband antenna 100 of the first embodiment is that the first end 121 of the connecting element 12 of the broadband antenna 200 is substantially perpendicular to a surface where the grounding element 13 is located to reduce space. Additionally, according to the second embodiment, the angle between the first end 121 of the connecting element 12 and the grounding element 13 can angle other than 90°, such as 80° or 70°.

Figure 5:
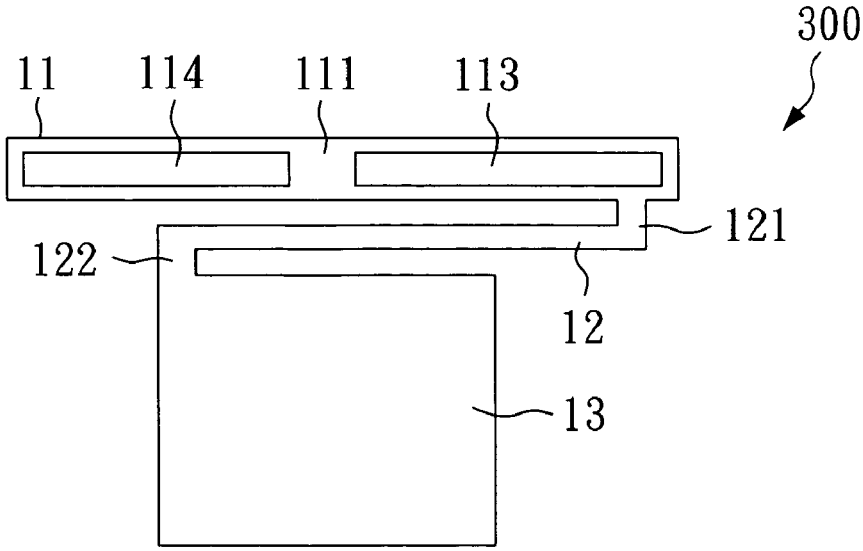
FIG. 5 is a schematic drawing of a broadband antenna according to a third embodiment of the present invention.

Please refer to FIG. 5. FIG. 5 is a schematic drawing of a broadband antenna according to a third embodiment of the present invention. As shown in FIG. 5, the main difference between the broadband antenna 300 of the third embodiment and the broadband antenna 100 of the first embodiment is that the body section 111 of the broadband antenna 300 forms two closed hollow sections 113 and 114. In this manner, the broadband antenna 300 still provides a wide bandwidth, dual band response. Moreover, the number of the hollow sections is not limited to two, that is, more than two hollow sections can be provided, such as three or four.

Figure 6A:
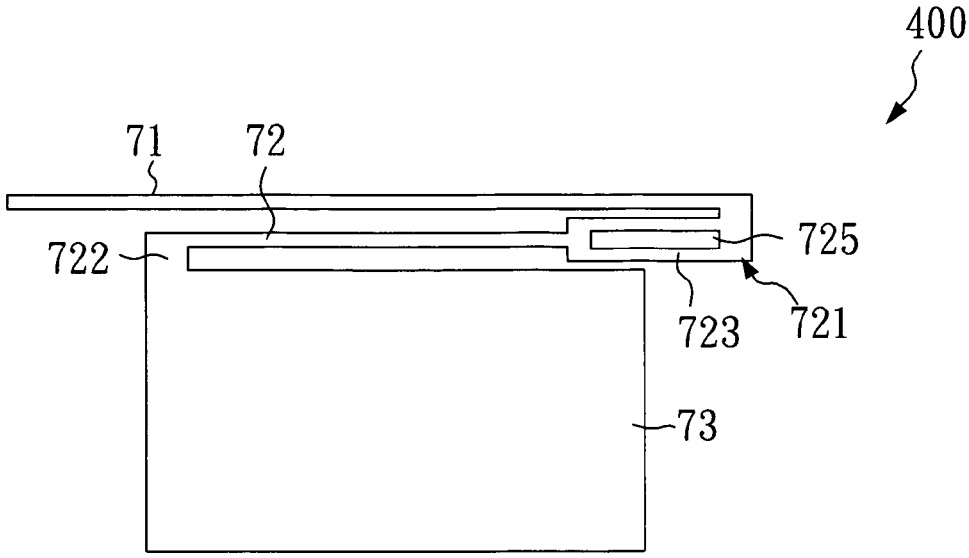
FIG. 6A is a schematic drawing of a broadband antenna according to a fourth embodiment of the present invention.
Figure 6B:
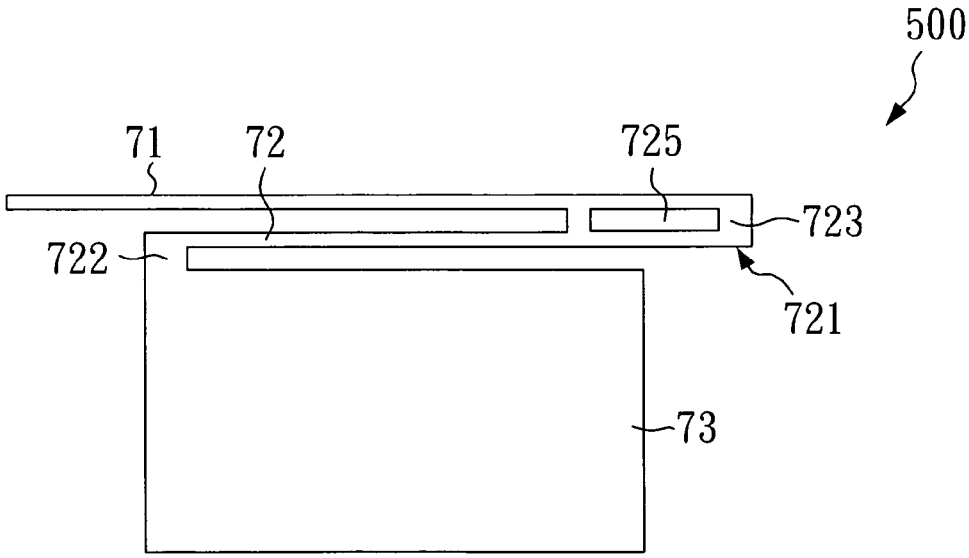
FIG. 6B is a schematic drawing of a broadband antenna according to a fifth embodiment of the present invention.

Please refer to FIG. 6A and FIG. 6B. FIG. 6A is a schematic drawing of a broadband antenna according to a fourth embodiment of the present invention. FIG. 6B is a schematic drawing of a broadband antenna according to a fifth embodiment of the present invention. As shown in FIG. 6A and FIG. 6B, the main difference between the broadband antennas of the fourth and fifth embodiment of the present invention and the prior art antenna 90 is that the first end 921 of the connecting element 92 of the prior art antenna 90 (as shown in FIG. 1) is replaced by a first end 721 having a closed looped structure. As shown in FIG. 6A and FIG. 6B, each broadband antenna 400 and 500 has a radiating element 71, a connecting element 72 and a grounding element 73. The connecting element 72 has a first end 721 and a second end 722. The first end 721 is electrically connected to the radiating element 71, and the second end 722 is electrically connected to the grounding element 73. The first end 721 has a closed looped structure and contains a body section 723 and a hollow section 725 formed by closed compassing by the body section 723.

In FIG. 6A and FIG. 6B, the body section 723 and the hollow section 725 are substantially rectangular, but this should not be construed as a limitation. The body section 723 and the hollow section 725 can also be triangular, pentagonal or other shapes.

Figure 7:
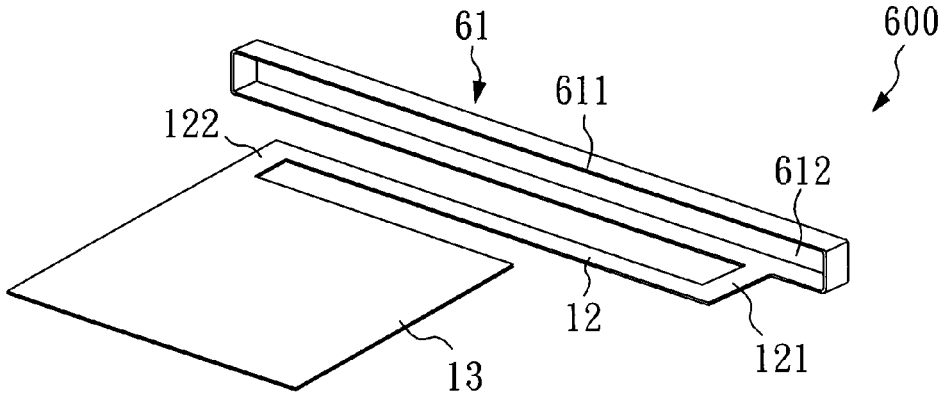
FIG. 7 is a schematic drawing of a broadband antenna according to a sixth embodiment of the present invention.

Please refer to FIG. 7. FIG. 7 is a schematic drawing of a broadband antenna according to a sixth embodiment of the present invention. As shown in FIG. 7, in the sixth embodiment, the closed looped radiating element 11 formed by the conductive plate is replaced by a closed looped radiating element 61 formed by a conductive pillar. The closed looped radiating element 61 is a rectangular pillar and has four surfaces which form a body section 611 and a closed hollow section 612. The closed looped radiating element 61 can further improve the frequency bandwidth response and antenna efficiency of the broadband antenna 600.

Figure 8:
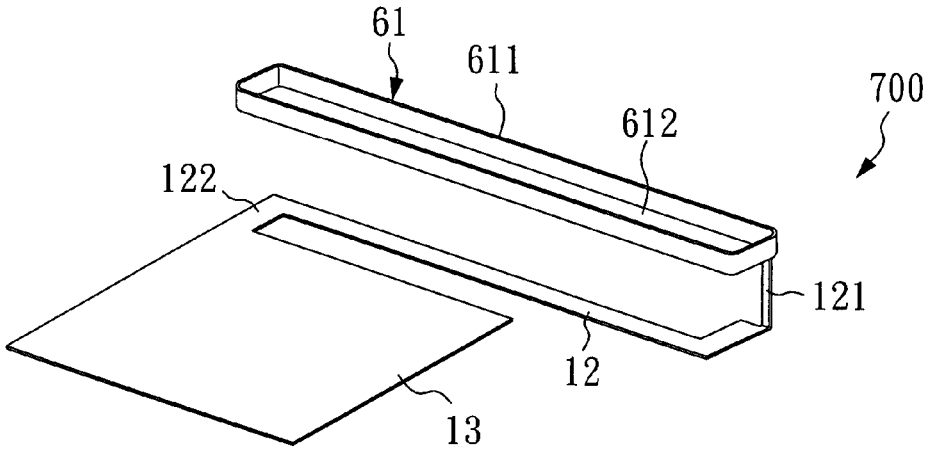
FIG. 8 is a schematic drawing of a broadband antenna according to a seventh embodiment of the present invention.

As shown in FIG. 7, in the broadband antenna 600, the first end 121 of the connecting element 12 is substantially parallel to the surface where the grounding element 13 is located, and a center axis of the closed looped radiating element 61 is also substantially parallel to the surface where the grounding element 13 is located, but this should not be construed as a limitation. For example, as shown in FIG. 8, in a broadband antenna 700 of a seventh embodiment, the first end 121 of the connecting element 12 is substantially perpendicular to the surface where the grounding element 13 is located, and a center axis of the closed looped radiating element 61 is also substantially perpendicular to the surface where the grounding element 13 is located.

Figure 9:
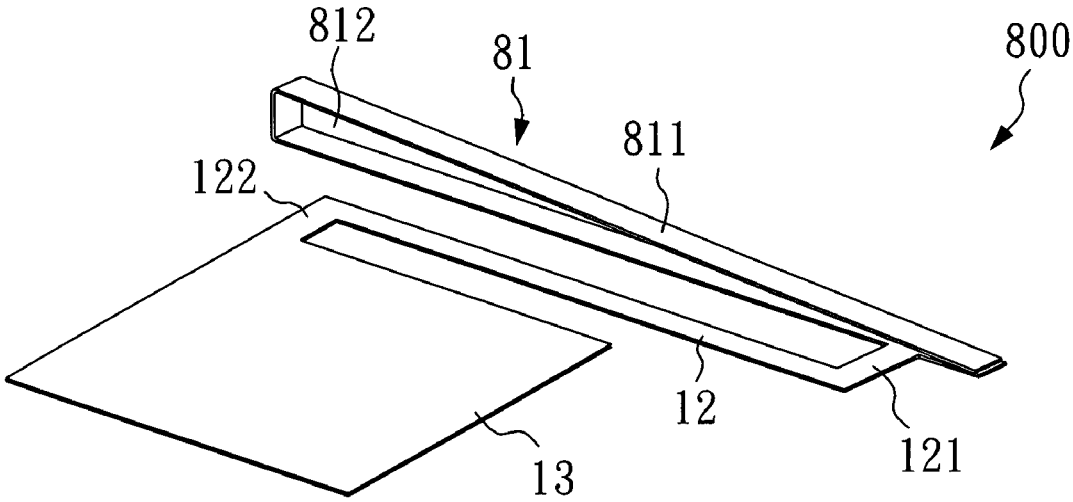
FIG. 9 is a schematic drawing of a broadband antenna according to an eighth embodiment of the present invention.

As shown in FIG. 7, the closed looped radiating element 61 is a rectangular pillar and has four surfaces that form the body section 611 and the closed hollow section 612. However, the closed looped radiating element 61 in the present invention can be replaced by other closed looped radiating elements that have different shapes and can still achieve the same goal thereby. For example, as shown in FIG. 9, in a broadband antenna 800 of an eighth embodiment, the closed looped radiating element 61 with the rectangular pillar shape can be replaced by a closed looped radiating element 81 with a triangular pillar shape, wherein the closed looped radiating element 81 has three surfaces that form a body section 811 and a closed hollow section 812.

The present invention also provides an electronic device having the above-mentioned broadband antennas 100, 200, 300, 400, 500, 600, 700 or 800, which can receive and transmit radio signals via the broadband antenna. For example, as shown in FIG. 10A to FIG. 10C, a notebook computer 2, a mobile phone 3 and a PDA 4 all have the broadband antenna according to the present invention for receiving and transmitting radio signals.

Figure 10A:
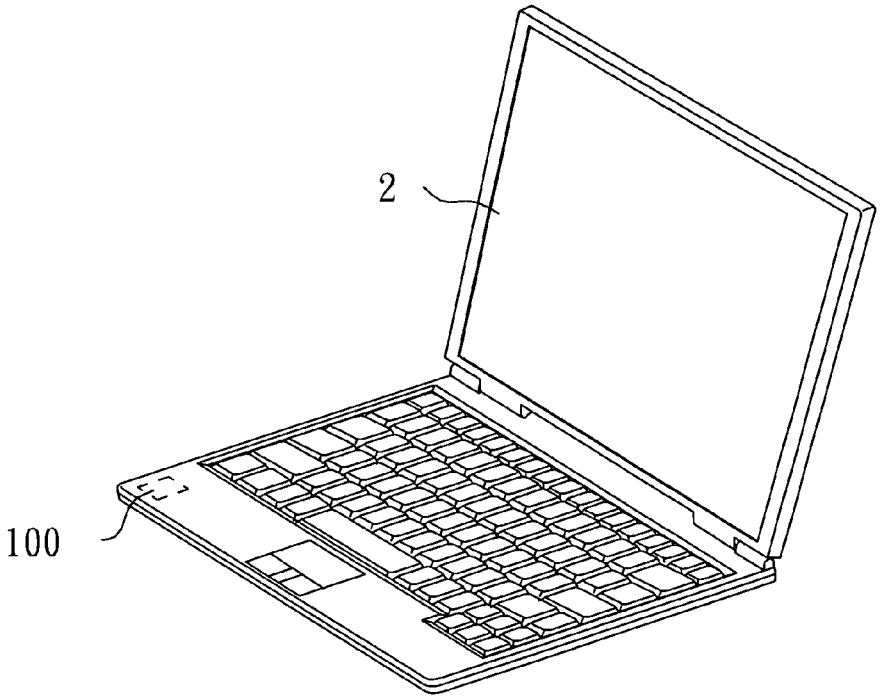
FIG. 10A is a schematic drawing of a notebook computer with the broadband antenna according to the present invention.
Figure 10B:
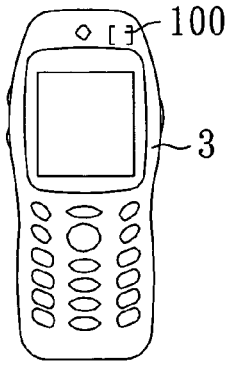
FIG. 10B is a schematic drawing of a mobile phone with the broadband antenna according to the present invention.
Figure 10C:
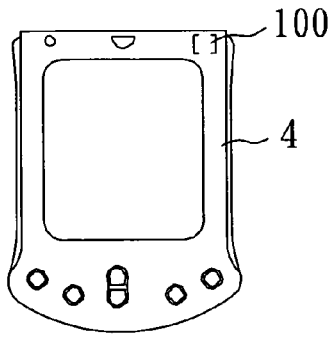
FIG. 10C is a schematic drawing of a PDA with the broadband antenna according to the present invention.

It should be noted that the broadband antenna 100, or other broadband antennas 200, 300, 400, 500, 600, 700 or 800, can be mounted at positions different from the ones shown in FIG. 10A to FIG. 10C according to the layout design of the notebook computer 2, the mobile phone 3 and the PDA 4.

Although the present invention has been explained in relation to its preferred embodiment, it is to be understood that many other possible modifications and variations can be made without departing from the spirit and scope of the invention as hereinafter claimed.

What is claimed is:

1. A broadband antenna, comprising:

a closed looped radiating element having a body section and a hollow section formed by closed compassing by the body section;

a grounding element; and a connecting element having a first end electrically connected to the closed looped radiating element and a second end electrically connected to the grounding element; wherein the closed looped radiating element is formed by a pillar that contains the body section and the hollow section.

2. The broadband antenna as claimed in claim 1 wherein a center axis of the pillar is substantially parallel to a surface where the grounding element is located.

3. The broadband antenna as claimed in claim 1 wherein a center axis of the pillar is substantially perpendicular to a panel where the grounding element is located.

4. The broadband antenna as claimed in claim 1 wherein the pillar is a rectangular pillar, and the rectangular pillar has four surfaces forming the body section and the hollow section.

5. A broadband antenna, comprising:

a closed looped radiating element having a body section and a hollow section formed by closed compassing by the body section;

a grounding element; and a connecting element having a first end electrically connected to the closed looped radiating element and a second end electrically connected to the grounding element; wherein the closed looped radiating element is formed by a pillar that contains the body section and the hollow section; and the pillar is a triangular pillar that has three surfaces forming the body section and the hollow section.

6. An electronic device, comprising:

a broadband antenna comprising:

a closed looped radiating element having a body section and a hollow section formed by closed compassing by the body section;

a grounding element; and a connecting element having a first end electrically connected to the closed looped radiating element and a second end electrically connected to the grounding element;

wherein the closed looped radiating element is formed by a pillar that contains the body section and the hollow section.

7. The electronic device as claimed in claim 6 wherein a center axis of the pillar is substantially parallel to a surface where the grounding element is located.

8. The electronic device as claimed in claim 6 wherein a center axis of the pillar is substantially perpendicular to a panel where the grounding element is located.

9. The electronic device as claimed in claim 6 wherein the pillar is a rectangular pillar, and the rectangular pillar has four surfaces forming the body section and the hollow section.

* * * * *